US006996866B2

(12) United States Patent
Carlitz

(10) Patent No.: US 6,996,866 B2
(45) Date of Patent: Feb. 14, 2006

(54) MATTRESS STRUCTURE WITH AN IMPROVED LUMBAR ZONE

(75) Inventor: Stuart Scott Carlitz, Holland Bucks, PA (US)

(73) Assignee: Mattress Development Company, Wilmington, DE (US)

( * ) Notice: Subject to any disclaimer, the term of this patent is extended or adjusted under 35 U.S.C. 154(b) by 0 days.

(21) Appl. No.: 10/502,970

(22) PCT Filed: Jan. 29, 2002

(86) PCT No.: PCT/US02/02460

§ 371 (c)(1),
(2), (4) Date: Mar. 2, 2005

(87) PCT Pub. No.: WO03/063652

PCT Pub. Date: Aug. 7, 2003

(65) Prior Publication Data

US 2005/0166329 A1 Aug. 4, 2005

(51) Int. Cl.
*A47C 23/053* (2006.01)
*A47C 27/07* (2006.01)

(52) U.S. Cl. ..... 5/721; 5/267; 5/260; 5/248; 267/86

(58) Field of Classification Search ..... 5/721, 5/267, 248, 717, 716, 246, 260; 267/86
See application file for complete search history.

(56) References Cited

U.S. PATENT DOCUMENTS

| | | | | |
|---|---|---|---|---|
| 986,723 A | | 3/1911 | King | |
| 1,067,193 A | * | 7/1913 | Phelps | 5/248 |
| 1,897,402 A | | 2/1933 | Stackhouse | |
| 2,002,157 A | | 5/1935 | Reed | |
| 2,012,575 A | | 8/1935 | McInerney | |
| 2,131,071 A | * | 9/1938 | Raduns | 5/267 |
| 2,184,517 A | | 12/1939 | Duvall et al. | |
| 2,272,493 A | | 2/1942 | Williams | |
| 2,383,157 A | | 8/1945 | Pink | |
| 2,576,729 A | | 11/1951 | Shockey | |
| 2,589,053 A | | 3/1952 | Clark | |
| 2,681,457 A | | 6/1954 | Rymland | |
| 2,853,721 A | | 9/1958 | Koenigsberg | |
| 3,032,782 A | * | 5/1962 | Sharfe et al. | 5/721 |
| 3,242,505 A | * | 3/1966 | Tyhanic | 5/246 |
| 3,517,398 A | | 6/1970 | Patton | |
| 3,735,431 A | * | 5/1973 | Zocco | 5/267 |
| 3,840,915 A | * | 10/1974 | Simon | 5/261 |
| 4,122,566 A | | 10/1978 | Yates | |

(Continued)

*Primary Examiner*—Robert G. Santos
(74) *Attorney, Agent, or Firm*—Dinsmore & Shohl LLP

(57) ABSTRACT

A mattress spring structure (10) is provided with a strengthened central area (C) thereon to provide greater support for a user's body lumbar region when received thereon. The support is provided with a strengthening structure (30) having a continuous frame member (54) and a strengthening pattern (53). The continuous frame (54) encircles coil springs (12) over a major expanse of the mattress's central area (C); this frame is connected to mattress coils along the frames longitudinal (34, 36) and traverse (38, 40) segments. The strengthening pattern (53) has two metal bars (51, 52) arranged inside and connected to the continuous frame member (54). The strengthening pattern (53) may be connected to the spring coils (12) and contain additional metal straps (56, 59). The strengthening structure (30) is positioned and arranged to causes substantially uniform depression of adjacent coil springs to the continuous frame member (54) in the lumbar zone thereby eliminating any undesired upward pressure into the user's back.

16 Claims, 5 Drawing Sheets

U.S. PATENT DOCUMENTS 4,139,919 A 2/1979 Simon
4,180,877 A 1/1980 Higgins
4,348,014 A * 9/1982 Litkewycz ..... 267/87
4,369,534 A 1/1983 Wright
4,771,495 A 9/1988 Distler et al.
5,027,459 A * 7/1991 Perry et al. ..... 5/721
5,325,553 A 7/1994 Ripley et al.
5,570,484 A 11/1996 Ogle

* cited by examiner

MATTRESS STRUCTURE WITH AN IMPROVED LUMBAR ZONE

The present invention relates to mattress structures and in particular to a mattress spring structure with an improved lumbar zone support.

In the past, mattress construction concentrated on the innerspring construction to support the user's lumbar region such as, for example, by varying spring tensions, and material gauge. U.S. Pat. No. 5,325,553 to Ripley et al. provided more attention to the mattress, specifically a spring structure providing support with a continuous frame that encircled coil springs over a major expanse of the central area of the mattress that usually receives and supports the lumbar region of the user's back. While the problem of lumbar support has been partially solved by the mattress structure of Ripley et al., there remains the particular problem of the mattress springs on either side of the traverse frame bars depressing lower than the said bars when the user is received thereon, whereby creating undesired upward pressure into the user's back. This has been a particular problem that prior art mattress structures have attempted to address.

In particular, the mattress structures disclosed by U.S. Pat. No. 2,383,157 to Pink and U.S. Pat. No. 2,131,071 to Radnus both amplify the firmness of certain surface areas of a mattress spring structure by using metallic strips/wire to frame two separate reinforced areas per mattress.

U.S. Pat. No. 3,242,505 to Tyhanic discloses a mattress structure that uses multiple flat bands that traverse the mattress covering the center of the spring coils. The flat bands are connected to an encircling wire frame thereby creating a more uniform horizontal depression of the mattress structure when the user is received on said mattress.

The mattress structures disclosed by U.S. Pat. No. 4,122,566 to Yates and U.S. Pat. No. 5,570,484 to Ogle create two bordered areas of coil springs per mattress spring structure surface, four total, thereby increasing firmness over specific areas of said mattress.

The mattress structure disclosed by U.S. Pat. No. 4,180,877 to Higgins increases mattress spring structure firmness in selected areas using a welded wire grid structure attached to the opposite sides of said mattress.

U.S. Pat. No. 4,348,014 to Litkewycz discloses a mattress structure that increases the firmness of a bedding unit through the use of an auxiliary panel that has a wire border and a plurality of torsion bar springs extending between opposites portions of the peripheral wire and are connect to said wire thereby creating cooperation between coil springs when depressed.

The mattress structure disclosed by U.S. Pat. No. 4,369,534 to Wright increases the firmness of a pre-selected center area of a mattress spring assembly using a grid structure attached to the opposite sides of the mattress. The grid structure is comprised of plastic straps extending diametrically across the mattress in the center third area and overlaid by a preformed wire grid. The plastic straps and wire grid are attached to pre-assembled spring core by conventional connectors such as metal clips and/or hog rings.

U.S. Pat. No. 5,027,459 to Perry, Jr. et al. discloses a mattress structure that creates surface lift through "trampoline" grids on each horizontal plane of the mattress that are connected to the mattress perimeter by a band apparatus.

While the above mentioned prior art mattress structures provide a degree of added support and firmness to certain surface areas of mattress spring structures, they do so with the inefficient use of materials and overly complicated designs. The costs of materials and manufacturing are not taken into account by the prior designs. The complicated structures make it difficult to construct and increase the time to manufacture, thus raising the manpower cost per mattress and lowering the volume of output. Not only do the excessive amounts of material add to the complicated manufacturing process, they also increase the material cost per mattress.

Therefore, what is need is a mattress structure with an improved lumbar zone that does not create an undesired upward pressure into the back of a user's when received thereon, and which can be economically provided.

The above noted problems are herein solved by the present invention in where provided is a mattress spring structure with a strengthened central area which provides greater support for a user's body lumbar region when received thereon. The mattress spring structure has a plurality of coil springs arrayed in longitudinal and traverse rows within framed borders. The total number, size, compression, and alignment of springs used may vary.

A strengthening structure having a continuous frame member and a strengthening pattern is mounted on the coil springs in such a manner to provide the added support. The continuous frame is a single rod shaped to have a rectangular planner profile encircling and defining the central area of the mattress surface. The continuous frame is connected to first and last traverse rows of coil springs in the central area and extra central area traverse coil rows next adjacent the said first and last rows. The frame also is connected to adjacently paired longitudinally arrayed coil springs in the central area at both lateral sides of the springs structure.

The strengthening pattern is located within the area encompassed by the continuous frame. The pattern has two metal bars with opposing ends which connect to the continuous frame. The pattern may also comprise a signal bar with opposing ends. The strengthening pattern may contain straps connecting the bars for added support. The strengthening pattern may be attached to the coil springs with clip fasteners in a manner similar to the frame member. The connection may also be made with hog rings, windings, and fasteners commonly used in this art. Additionally, the strengthening pattern may lie freely on the coil springs.

The strengthening pattern may be provided in a number of advantageous and economical configurations. In a first configuration according to the present invention, the strengthening pattern's support bars cross one another substantially in the central region of the area encompassed by the frame. In this configuration, a first support bar extends from the upper left region of the frame member to the lower right region of the frame member. A second support bar extends from the upper right region of the frame member to the lower left region of the frame member.

It is to be appreciate that metal straps may be included in the above mentioned strengthening pattern configuration, such that a first strap connects the upper parts of the support bars in the upper region of the area encompassed by the continuous frame. A second strap connects the lower parts of the support bars in the lower region of the area encompassed by the continuous frame. A third strap connects the upper right part of one support bar to the lower right part of the other support bar in the right side of the area encompassed by the continuous frame member. Finally, a fourth strap connects the upper left part of one support bar to the lower left part of the other support bar in the left side of the area encompassed by the continuous frame member.

In another configuration, the strengthening pattern's support bars may be provided substantially parallel such that the support bars traverse the mattress area encompassed by the continuous frame member. In still another configuration, the strength pattern is a single bar with opposing ends shaped to have a rectangular planer profile.

In accordance with these and other objects of the present invention, there is provided a mattress spring structure having a plurality of coil springs arrayed in longitudinal and traverse rows of such coil springs. These coil springs extend between upper and lower margins and opposite side margins of the spring structure with the coils in each row aligned with the others. In each row the structure including a border piece which defines the upper, lower and side margins. Fastening devices secure each coil spring of each traverse row to a coil spring of an adjacent traverse row. A central area of the spring structure being defined by a selected succession of traverse rows of coil springs; and a strengthening structure receivable exteriorly against a major expanse of the spring structure central area. The strengthening structure has a continuous frame member encircling a major expanse of the spring structure's central area.

The strengthening structure includes a first traverse frame segment extending along a juncture of the coil springs of a traverse row first in selected succession of such with an extra succession traverse row adjacent thereto. Joining members closely join together the first traverse segment and each joined pair of coil springs in the first succession traverse row and the extra succession traverse row adjacent thereto. The strengthening structure further includes a second traverse frame segment extending along a juncture of the coil springs of a traverse row last in the selected succession of such with an extra succession traverse row adjacent thereto. Joining members closely join together the second traverse segment and each joined pair of coil springs in the last traverse row and the extra succession traverse row adjacent thereto. Further included is a pair of longitudinal frame segments spaced inwardly from the spring structure side margins and extending longitudinally in between adjacent longitudinal rows of coil springs, opposite ends of the traverse frame members being connected to opposite ends of the longitudinal frame members. Joining members, which closely join together the longitudinal frame segments and successive ones of pairs of coil springs, comprised each of a coil spring in one of the adjacent longitudinal rows and a coil spring in the other of the adjacent longitudinal rows. A strengthening pattern, located within and connected to the continuous frame member, the pattern is receivable exteriorly against the spring structure encircled by the continuous frame member, adapted to provide additional support to the user's lower back and causing uniform depression of coil springs limiting undesired upward pressure.

According to a still further feature of the present invention, there is provided a mattress spring structure having a plurality of coil springs arrayed in longitudinal and traverse rows of the coil springs between upper and lower margins and opposite side margins of the spring structure. These coils in each row aligned with the others in each row. The structure including a border piece which defines the upper, lower and side margins. Fastening devices secure each coil spring of each traverse row to a coil spring of an adjacent traverse row. A central area of the spring structure is defined by a selected succession of traverse rows of coil springs. Further provided is a strengthening structure received exteriorly against a major expanse of the spring structure central area. The strengthening structure has a continuous frame member encircling the major expanse of the spring structure central area. The strengthening structure includes a first traverse frame segment extending along a juncture of the coil springs of a traverse row first in selected succession of such with an extra succession traverse row adjacent thereto. Joining members closely join together said first traverse segment and each joined pair of coil springs in the first succession traverse row and the extra succession traverse row adjacent thereto. A second traverse frame segment extending along a juncture of the coil springs of a traverse row last in the selected succession of such with an extra succession traverse row adjacent thereto. Joining members closely join together the second traverse segment and each joined pair of coil springs in the last traverse row and the extra succession traverse row adjacent thereto. A pair of longitudinal frame segments spaced inwardly from the spring structure side margins and extending longitudinally in between adjacent longitudinal rows of coil springs, opposite ends of the traverse frame members being connected to opposite ends of the longitudinal frame members. Joining members, closely joining together the longitudinal frame segments and successive ones of pairs of coil springs, comprise each of a coil spring in one of the adjacent longitudinal rows and a coil spring in the other of the adjacent longitudinal rows. A pair of elongated metal elements possessing opposing ends, located within and connected to the continuous frame member, the elongated metal elements are receivable exteriorly against the mattress spring structure encircled by the continuous frame member wherein one of the elongated metal elements traverses the other elongated metal element.

According to still another further feature of the present invention, provided is a mattress spring structure having a plurality of coil springs arrayed in longitudinal and traverse rows of such coil springs between upper and lower margins and opposite side margins of the spring structure. These coils in each row aligned with the others in each row. The structure including a border piece which defines the upper, lower and side margins. Fastening devices secure each coil spring of each traverse row to a coil spring of an adjacent traverse row, a central area of the spring structure being defined by a selected succession of traverse rows of coil springs. A strengthening structure is received exteriorly against a major expanse of the spring structure central area. The strengthening structure has a continuous frame member encircling the major expanse of the spring structure central area, and includes a first traverse frame segment extending along a juncture of the coil springs of a traverse row first in selected succession of such with an extra succession traverse row adjacent thereto. Joining members closely join together the first traverse segment and each joined pair of coil springs in the first succession traverse row and the extra succession traverse row adjacent thereto. A second traverse frame segment extending along a juncture of the coil springs of a traverse row last in the selected succession of such with an extra succession traverse row adjacent thereto. Joining members closely join together the second traverse segment and each joined pair of coil springs in the last traverse row and the extra succession traverse row adjacent thereto. A pair of longitudinal frame segments spaced inwardly from the spring structure side margins and extending longitudinally in between adjacent longitudinal rows of coil springs, opposite ends of the traverse frame members being connected to opposite ends of the longitudinal frame members. Joining members, closely joining together the longitudinal frame segments and successive ones of pairs of coil springs, comprise each of a coil spring in one of the adjacent longitudinal rows and a coil spring in the other of the adjacent longitudinal rows. A pair of elongated metal elements possessing opposing ends, located within and connected to the continuous frame member, the elongated metal elements are receivable exteriorly against the spring structure encircled by the continuous frame member wherein the pair of metal elements are substantially parallel.

The above, and other objects, features and advantages of the present invention will become apparent from the following description read in conjunction with the accompanying drawings, in which like reference numerals designate the same elements.

The following detailed description of the embodiments of the present invention can be best understood when read in conjunction with the accompanying drawings, where like structure is indicated with like reference numerals and in which.

Figure 1:
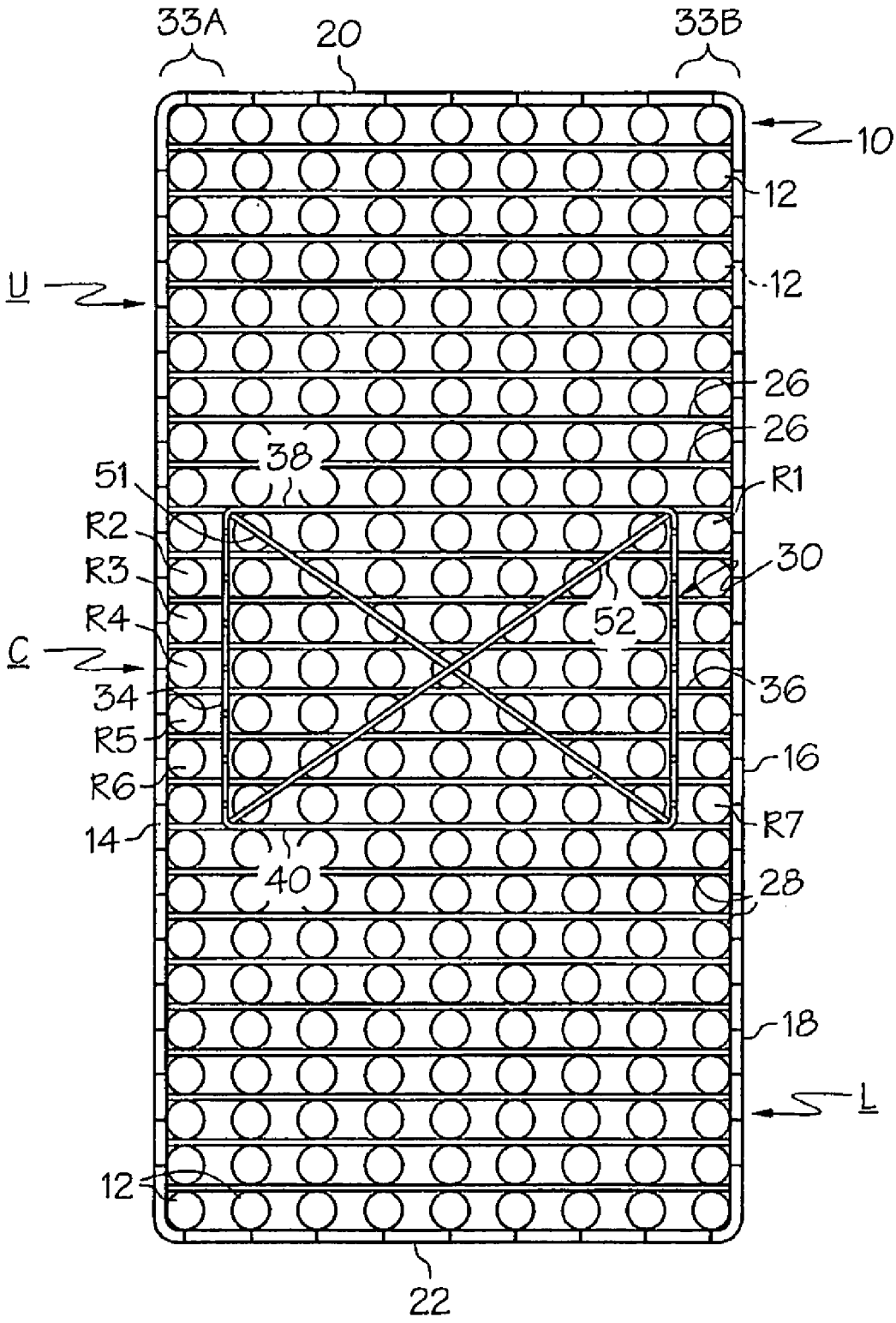
FIG. 1 is a plan view of a mattress spring structure constructed in accordance with the present invention.
Figure 2:
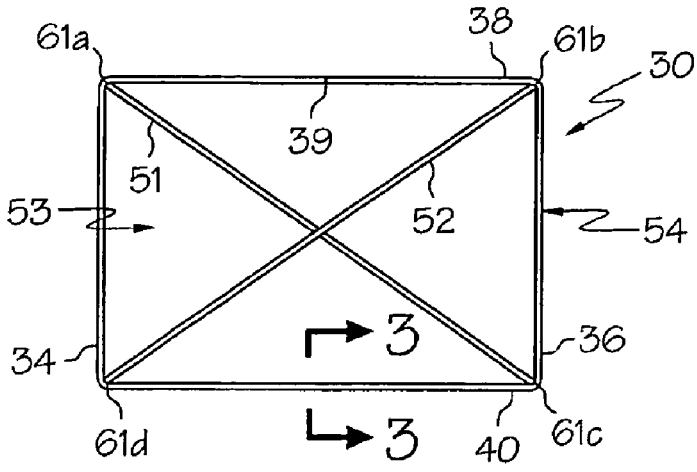
FIG. 2 is a plan view of a strengthening structure of a mattress structure comprising a continuous frame member and strengthening pattern with support bars crossing substantially in the center of the frame's encompassed area according to the present invention.
Figure 4A:
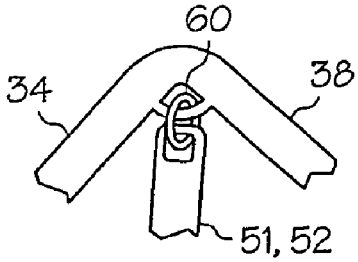
Figure 4B:
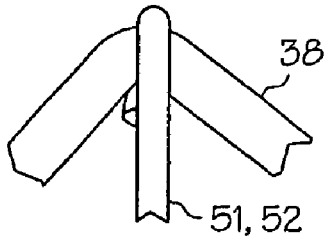
Figure 5A:
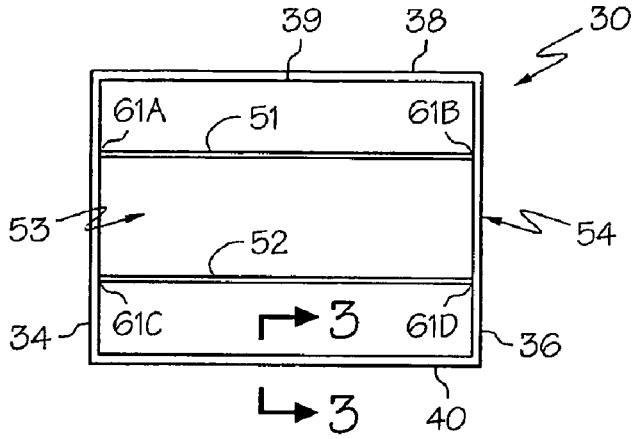
Figure 5B:
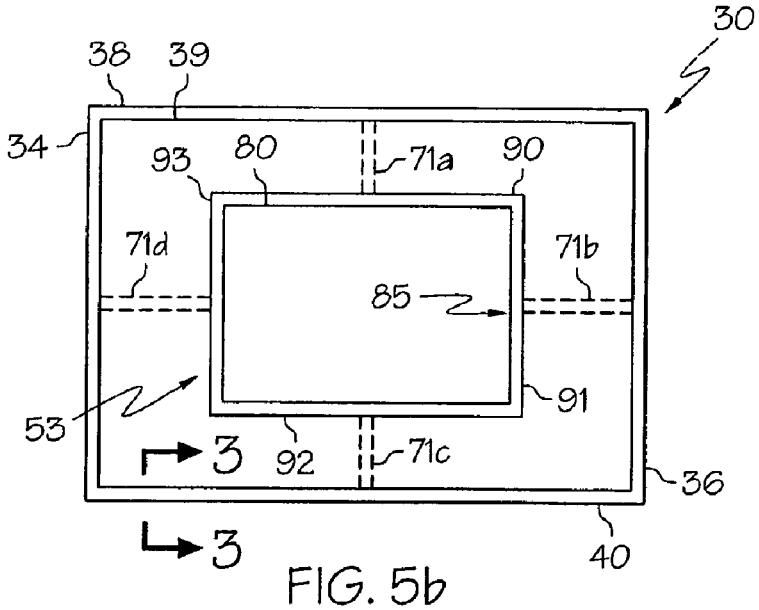
Figure 5C:
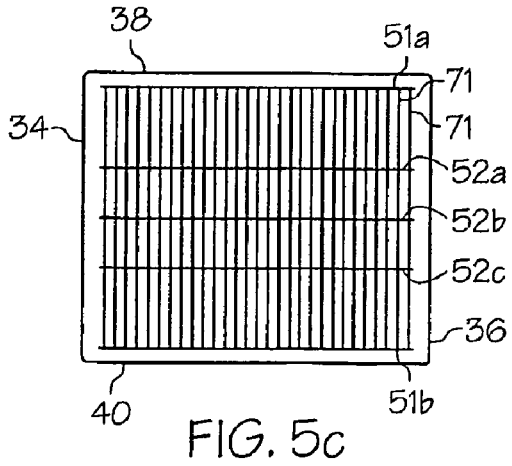
Figure 6:
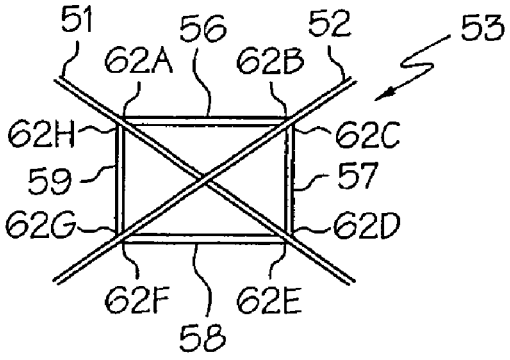
Figure 7:
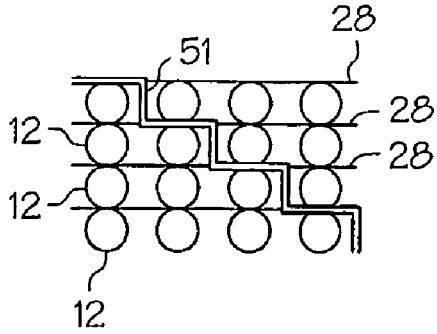
Figure 8:
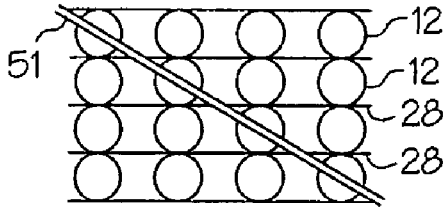
Figure 9:
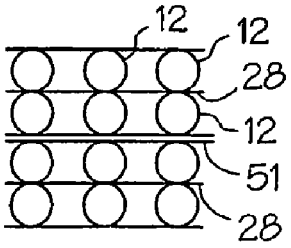
Figure 10:
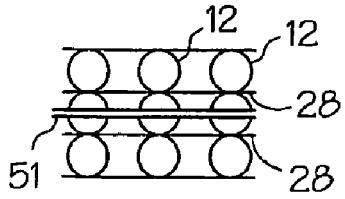
Figure 11:
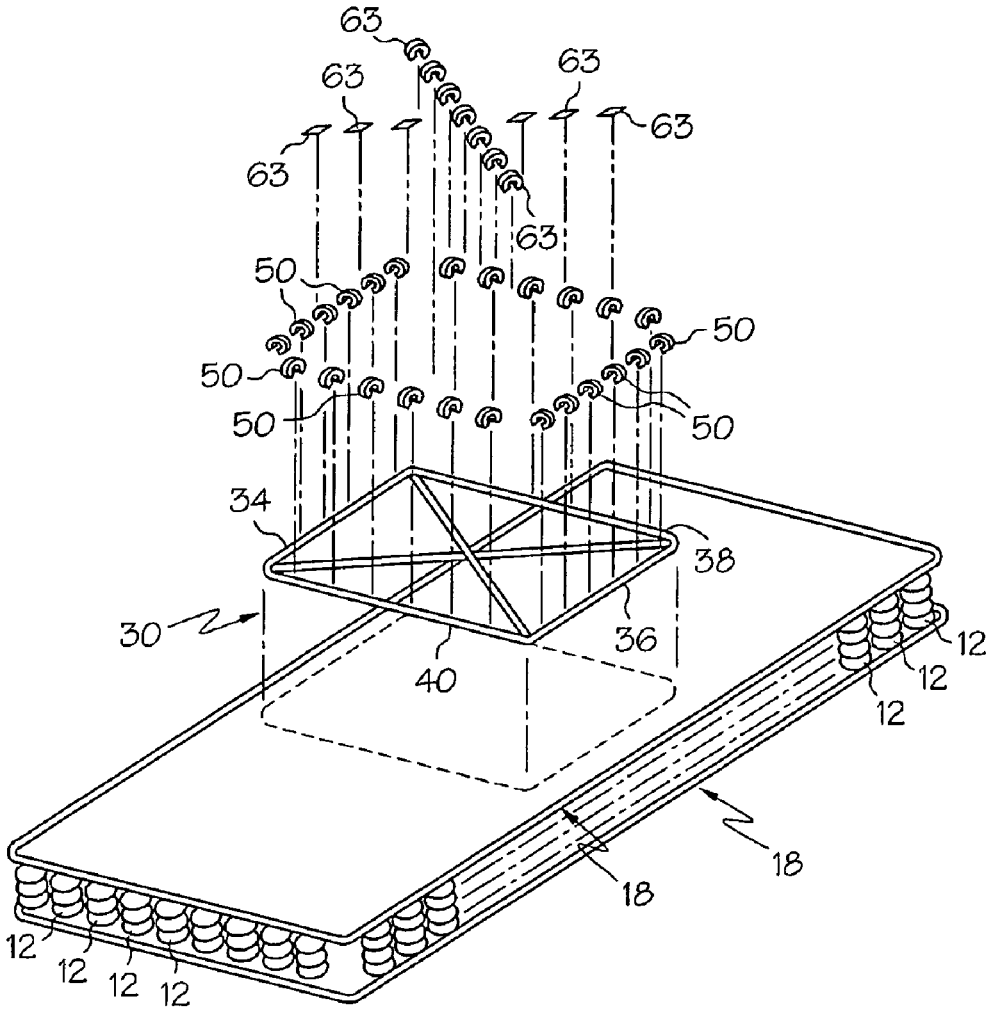
Figure 12:
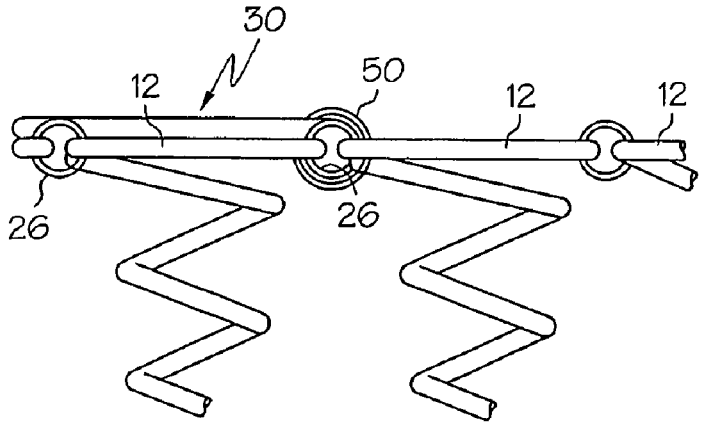
FIG. 12 ( PRIOR ART )

FIGS. 4*a* and 4*b* are illustrations showing methods of connecting a support bar to a frame member of a strengthening structure according to the present invention;

FIG. 5*a* is a plan view of a strengthening structure with a substantially parallel arrangement of support bars of a strengthening pattern connected to longitudinal boarders of a frame member according to the present invention;

FIG. 5*b* is a plan view of a strengthening structure with support bars of a strengthening pattern in a substantially rectangular configuration positioned within a continuous frame member according to the present invention;

FIG. 5*c* is a plan view of a strengthening structure with support bars of a strengthening pattern in a substantially parallel configuration positioned within a continuous frame member and having cross members according to the present invention;

FIG. 6 is a fragmented plan view of the strengthening pattern as shown in FIG. 2 with metal straps included in the strengthening pattern according to the present invention;

FIG. 7 is a fragmented plan view of a mattress structure with a support bar of a strengthening pattern with nearly right-angle bends to prevent the bar from substantially passing through a surface area of individual coil springs according to the present invention;

FIG. 8 is a fragmented plan view of a mattress structure with a straight support bar of a strengthening pattern diagonally crossing the mattress passing through the upper surface area of individual the coil springs according to the present invention;

FIG. 9 is a fragmented plan view of a mattress structure with a straight support bar of a strengthening pattern traversing the mattress without substantially passing through an upper surface area of individual coil springs according to the present invention;

FIG. 10 is a fragmented plan view of a mattress structure with a straight support bar of a strengthening pattern passing through an upper surface area of individual coil springs while traversing the mattress according to the present invention;

FIG. 11 is an exploded perspective view of the strengthening structure shown in FIG. 1 according to the present invention; and FIG. 12 is a fragmentary vertical sectional view depicting a manner of securing a strengthening structure according to the present invention to coil springs with prior art clip fasteners.

It is noted that the drawings of the invention are not to scale. The drawings are intended to depict only typical embodiments of the invention, and therefore should not be considered as limiting the scope of the invention.

Referring to FIG. 1, a mattress spring structure 10 comprises a plurality of coil springs 12 which can be arrayed in longitudinal and traverse rows. As shown, these rows extend crosswise of the structure between left and right side margins of the frame as defined by the respective longitudinal or side margin parts 14, 16 of a conventional frame border piece 18. The rows also extend longitudinally between top and bottom frame margins 20, 22 defined by traverse margin parts of a border piece 18. The coil springs 12 depicted in the FIG. 1 embodiment are all the same diameter and arrayed such that each coil spring in a given traverse or longitudinal row is aligned with the others in the given row.

The total number of springs used may vary as can spring size, compression, and the like. In addition, the coil spring alignment may vary such as, for example, a coil spring in one row need not align with one in an adjacent row. However, in a preferred embodiment, the springs in the uppermost and lowermost traverse rows of springs included in a spring structure central area C should be at least in part pairable with the extra central area rows of springs adjacent each upper and lowermost rows. Provided the coils in such a manner ensures that the coil springs in these traverse rows can be companion connected to each other and to a strengthening structure 30 as depicted in FIG. 1 which is described in greater detail in a later section. In like manner, springs in the longitudinal rows at the side parts of the central area should at least, in part, be pairable with adjacent row springs.

Each traverse row of coil springs of the mattress spring structure 10 is joined to an adjacent row in known manner, for example, with helical wire windings 26, these windings also being secured to a border piece 28. Further, the perimeter coil springs each can be connected to the border piece with known types of connectors (not shown).

Figure 3:
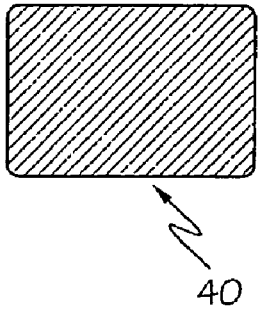
FIG. 3 is a section view, on enlarged scale, through the frame member taken on the section line 3—3 in FIG. 2.

As seen from FIG. 2, the strengthening structure 30 comprises two major components a frame member 54 and a strengthening pattern 53. Frame member 54 is a unitary component having longitudinal side segments 34, 36 joined to traverse segments 38, 40 in continuous encircling course. The frame member 54 conveniently can be fabricated from a length of high carbon steel rod of, e.g., 6 or 9 gauge which is shaped into the rectangular plan profile shown, and the confronting rod opposite ends welded together as at 39. The cross-section of the frame member 54 shown by the section view of FIG. 3, taken on the line 3—3 in FIG. 2, is rectangular but it is understood that the same could be square, hexagonal, circular, etc, as well.

The strengthening pattern 53 comprises two metal support bars received exteriorly over the area of the mattress spring structure 10 encircled by the frame member 54. The support bars 51,52 preferably are a polyethylene coated 14 gauge wire, however, other gauges and bar-types may be suitably used for the purpose described herein. The support bars 51, 52 have opposing ends which connect to the frame member 54 at corners 61, such as by a weld or any other mounting means. For example, FIG. 4*a* shows the strengthening pattern 53 connected to the frame by ring 60 connections, and FIG. 4*b* illustrates a conventional wire wrap connection. Further, the strengthening pattern 53 may be connected to the frame member 54 by hog rings, windings, or combinations thereof. Additionally, if desired, the strengthening pattern 53 may be positioned floating between the frame member 54.

FIG. 2 depicts bar 52 extending from the upper left corner of the frame member 54 to the lower right corner of the frame member crossing over the upper surface of support bar 51 which is extending from the upper right corner of the frame member to the lower left corner of the frame member. Further, it is understood that the strengthening pattern 53 could have support bar 51 traversing over the upper surface of support bar 52.

FIG. 5*a* depicts another embodiment of strengthening pattern 53 with support bar 51 and support bar 52 substantially parallel traversing the area encircle by the frame member 30. Support bar 51 is located above bar 52 in the framed area. One end of support bar 51 is joined to longitudinal frame segment 34, the opposing end of the said bar is connect to longitudinal frame segment 36 in the manner described above. Support bar 52 is connected to the longitudinal frame segments 34, 36 in the same manner. It is further understood that the support bars 51, 52 can connect anywhere on the longitudinal frame segments 34, 36.

FIG. 5*b* depicts still another embodiment of the strength pattern 53 with support bar 85. Support bar 85 is a unitary component having longitudinal segments 91, 93 joined to traverse segments 90, 92 in a continuous encircling course. The support bar 85 is a rod shaped in the rectangular plan profile illustrated by FIG. 3, and the confronting rod opposite ends held together by weld 80. For added support, cross members 71*a–d* (indicated by dashed lines) may be used to connect together opposed segments of both frame member 30 and strength pattern 53. The cross members 71*a*–71*d* may be welded at ends between opposed segments and/or each wrap therebetween, such that any compressive forces realized by any frame segment of frame member 30 will be distributed to its respective member of the strength pattern 53, and vice-versa. The strength pattern 53 may be secured to the mattress coil springs in a similar fashion as the frame member 30 as will be explained in a later section.

FIG. 5*c* depicts yet another embodiment of the strength pattern 53 with a plurality of support bars 51, 52 provided substantially parallel to traverse portions 38, 40 defining the width of the frame member 54. The support bars 51,53 are rod shaped in the rectangular plan profile illustrated by FIG. 3, and are held by a plurality of cross members 71 for added support. The cross members 71 may be wired wrapped at ends around the exterior support bars 51*a*, 51*b* and threaded through the remaining support bars 52*a–c* to maintain the shape of the strength pattern 53.

FIG. 6 is a fragmented view of the strengthening pattern 53 similar to the pattern depicted in FIG. 2 to include metal straps 56, 57, 58, 59 having opposing ends. Strap 56 traverses mattress surface in the upper region of the area encircled by frame member 54 joining the upper part of support bar 51 to the upper part of support bar 52. The opposing ends of strap 56 are welded to support bars 51, 52 at welds 62 A, B respectively. Strap 58 traverses mattress surface in the lower region of the area encircled by frame member 54 joining the lower part of support bar 51 to the lower part of support bar 52.

The opposing ends of strap 58 are welded to support bar 51, 52 at welds 62 E, F respectively. Strap 57 extends longitudinally over the mattress surface in the left region of the area encircled by frame member 54 joining the upper part of support bar 52 to the lower part of support bar 51. The opposing ends of strap 57 are welded to support bar 52, 51 at welds 62 C, B respectively. Strap 59 extends longitudinally over the mattress surface in the right region of the area encircled by frame member 54 joining the upper part of support bar 51 to the lower part of support bar 52. The opposing ends of strap 59 are welded to support bar 51, 52 at welds 62H, G respectively.

FIG. 7 is a fragmented view of support bar 51 diagonally crossing the mattress spring structure 10 with a plurality of substantially right angles positioned to avoid substantially passing through the upper plan surface area of the individual coil springs 12. It is understood support bar 52 would cross the mattress spring structure 10 in a similar manner respective to support bar 51.

FIG. 8 is a fragmented view of support bar 51 diagonally crossing the mattress spring structure 10. The straight support bar 51 is positioned to substantially cross over the center area of the upper plan surface of the individual coil springs 12. It is understood support bar 52 would cross the mattress spring structure 10 in a similar manner respective to support bar 51.

FIG. 9 is a fragmented view of support bar 51 traversing the mattress spring structure 10. The straight support bar 51 is positioned to substantially avoid passing through the upper plan surface area of the individual coil springs 12. It is understood support bar 52 would cross the mattress spring structure 10 in a similar manner respective to support bar 51.

FIG. 10 is a fragmented view of support bar 51 traversing the mattress spring structure 10. The straight support bar 51 is positioned to substantially pass through the center plan area of individual coil springs 12. It is understood support bar 52 would cross the mattress spring structure 10 in a similar manner respective to support bar 51.

Placement positioning of the strengthening structure 30 as well as means by which it is secured to the frame structure is readily seen with reference to the exploded showing of FIG. 11.

With reference again to FIG. 1, strengthening structure 30 is mounted on the coil springs 12 in such manner as to encompass a major expanse of a selected succession of traverse rows of coil springs R1–R7 which define the central area C of the mattress structure. In that disposition, the segments 38, 40 of the frame member 54 overlay the junctures, respectively, of the succession uppermost and lowermost coil spring rows R1 and R7 with respective frame upper area U and lower area L coil spring rows next adjacent to rows R1 and R7.

The opposite ends of the segments 38, 40 it will be noted are spaced inwardly at least one spring diameter from the side margins parts 14, 16 of the mattress spring structure 10. Such opposite ends are situated at a location intervening the lateral most longitudinal spring rows in the central area C and the next inboard or adjacent rows to the lateral most rows. The lateral most longitudinal spring row is indicated by 33A and 33B for the spring rows running adjacent segments 34 and 36, respectively.

Segment 38 is connected to each of the traverse paired coil springs in row R1 and the above adjacent central area traverse row, except no connection is provided to the springs provided adjacently in the lateral most rows 33A and 33B. In the illustrated embodiment, the connection is effected with conventional clip fasteners 50, which are shown in FIG. 12. In other embodiments, the joining of the elements may be made with windings encircling the elements and the windings being deformed closely against the encircled structures. The connection may also be made with hog rings or other fasteners commonly used in this art. Segment 40 is connected in like fashion with the traverse row R7 and the traverse row of area L next below.

The longitudinal frame segments 34, 36 are connected to paired coil springs of the longitudinal spring rows first and second closest to the side margins part 14, 16 of the mattress spring structure 10. If the frame member 54 was made narrower, the frame segments 34, 36 could locate in between the second and third longitudinal spring rows in which case the segments would be connected to paired coils in these rows. The joining of the elements is in a manner similar to segments 38, 40 using clip fasteners 50 as seen in FIG. 12. The connection also can be made with hog rings or other fasteners commonly used in this art.

In FIG. 11, the strengthening pattern 53 is attached to the coil springs with clip fasteners 63 in a manner similar to the frame member 54. The number and positioning of the clip fasteners 63 will vary according to the arrangement of the strengthening pattern 53, number and size of coil springs 12, and the like. The connection also can be made with hog rings, windings, fasteners commonly used in this art. It is also understood that the strengthening pattern 53 can lie freely on the coil springs 12.

The sum effect of connecting the strengthening structure to the coil springs in the manner aforesaid is to restrict travel movement of these springs responsive to imposition of user body weight thereon. This strengthens the central zone C where the user's body lumbar region normally will be received.

The numbers of traverse rows of coil springs can be varied depending on spring size. The FIG. 1 depiction is representative of a desired arrangement wherein the areas U and L have each the same number of rows (9) but at least two greater than used in the area C (7).

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a mattress spring structure having:

a plurality of coil springs arrayed in longitudinal and traverse rows of such coil springs between upper and lower margins and opposite side margins of said spring structure, with the coils in each row aligned with the others in each said row, the structure including a border piece which defines said upper, lower and side margins;

a fastening device securing each coil spring of each traverse row to a coil spring of an adjacent traverse row, a central area of the spring structure being defined by a selected succession of traverse rows of coil springs, wherein the number of traverse rows of coil springs in an upper spring structure area between the upper margin and the central area and in a lower spring structure area between the lower margin and the central area are greater than or equal to the number of traverse rows of coil springs in the central area; and a strengthening structure receivable exteriorly against a major expanse of the spring structure central area, the strengthening structure characterized by:

a continuous frame member encircling a major expanse of the spring structure central area, including a first traverse frame segment extending along a juncture of the coil springs of a traverse row first in selected succession of such with an extra succession traverse row adjacent thereto, there being joining members closely joining together said first traverse segment and each joined pair of coil springs in said first succession traverse row and the extra succession traverse row adjacent thereto, a second traverse frame segment extending along a juncture of the coil springs of a traverse row last in the selected succession of such with an extra succession traverse row adjacent thereto, there being joining members closely joining together said second traverse segment and each joined pair of coil springs in the last traverse row and the extra succession traverse row adjacent thereto, a pair of longitudinal frame segments spaced inwardly from the spring structure side margins and extending longitudinally in between adjacent longitudinal rows of coil springs, opposite ends of the traverse frame members being connected to opposite ends of the longitudinal frame members, there being joining members, closely joining together said longitudinal frame segments and successive ones of pairs of coil springs comprised each of a coil spring in one of the adjacent longitudinal rows and a coil spring in the other of the adjacent longitudinal rows; and a strengthening pattern located within said continuous frame member and received against the spring structure encircled by the continuous frame member, said strengthening pattern is adapted to cause uniform depression of said coil springs limiting undesired upward pressure and comprises elongated metal elements and metal straps joined to the elongated metal elements.

2. The mattress spring structure as recited in claim 1 wherein the means for securing said longitudinal and traverse continuous frame segments to said coil springs in the respective traverse and longitudinal coil spring rows comprises clip fasteners.

3. The mattress spring structure as recited in claim 1 wherein said elongated metal elements having opposing ends connected to the continuous frame member.

4. The mattress spring structure as recited in claim 1 wherein said elongated metal elements having opposing ends connected to the continuous frame member with one of said elongated metal elements crossing over another one of said elongated metal elements.

5. The mattress spring structure as recited in claim 1 wherein said elongated metal elements having opposing ends connected to the continuous frame member of the strengthening structure with said elongated metal elements being substantially parallel to one another.

6. The mattress spring structure as recited in claim 1 wherein said elongated metal elements are positioned within said continuous frame member to pass substantially through the center of the upper plan surface area of individual coil springs.

7. The mattress spring structure as recited in claim 1 wherein said elongated metal elements are positioned within said continuous frame member to substantially remain outside of individual coil springs upper plan surface area.

8. The mattress spring structure as recited in claim 1 wherein said elongated metal elements are positioned substantially parallel to each other within said continuous frame member.

9. The mattress spring structure as recited in claim 1 wherein said strengthening pattern is attached to said coil springs with clip fasteners.

10. The mattress spring structure as recited in claim 1 wherein said coil springs are connected by hog rings.

11. The mattress spring structure as recited in claim 1 wherein said continuous frame member is a shaped single piece rod element of rectangular plan profile, the traverse frame segments being of greater length than the longitudinal frame segments.

12. The mattress spring structure as recited in claim 1 wherein said continuous frame member is a shaped rod element.

13. The mattress spring structure as recited in claim 1 wherein the number of traverse rows of coils in the upper, central and lower areas is nearly in a proportion 3:2:3.

14. The mattress spring structure in accordance with claim 1 wherein the number of traverse rows of coils in the central area is seven.

15. In a mattress spring structure having:

a plurality of coil springs arrayed in longitudinal and traverse rows of such coil springs between upper and lower margins and opposite side margins of said spring structure, with the coils in each row aligned with the others in each said row, the structure including a border piece which defines said upper, lower and side margins;

a fastening device securing each coil spring of each traverse row to a coil spring of an adjacent traverse row, a central area of the spring structure being defined by a selected succession of traverse rows of coil springs; and a strengthening structure receivable exteriorly against a major expanse of the spring structure central area, the strengthening structure characterized by:

a continuous frame member encircling a major expanse of the spring structure central area, including a first traverse frame segment extending along a juncture of the coil springs of a traverse row first in selected succession of such with an extra succession traverse row adjacent thereto, there being joining members closely joining together said first traverse segment and each joined pair of coil springs in said first succession traverse row and the extra succession traverse row adjacent thereto, a second traverse frame segment extending along a juncture of the coil springs of a traverse row last in the selected succession of such with an extra succession traverse row adjacent thereto, there being joining members closely joining together said second traverse segment and each joined pair of coil springs in the last traverse row and the extra succession traverse row adjacent thereto, a pair of longitudinal frame segments spaced inwardly from the spring structure side margins and extending longitudinally in between adjacent longitudinal rows of coil springs, opposite ends of the traverse frame members being connected to opposite ends of the longitudinal frame members, there being joining members, closely joining together said longitudinal frame segments and successive ones of pairs of coil springs comprised each of a coil spring in one of the adjacent longitudinal rows and a coil spring in the other of the adjacent longitudinal rows; and a strengthening pattern including a pair of elongated metal elements possessing opposing ends, located within and connected to said continuous frame member, and a plurality of metal straps with opposing ends joined to said elongated metal elements, said pattern is received against the spring structure area encircled by said continuous frame member wherein one of said elongated metal elements crosses over the other said elongated metal element.

16. In a mattress spring structure having:

a plurality of coil springs arrayed in longitudinal and traverse rows of such coil springs between upper and lower margins and opposite side margins of said spring structure, with the coils in each row aligned with the others in each said row, the structure including a border piece which defines said upper, lower and side margins;

a fastening device securing each coil spring of each traverse row to a coil spring of an adjacent traverse row, a central area of the spring structure being defined by a selected succession of traverse rows of coil springs; and, a strengthening structure receivable exteriorly against a major expanse of the spring structure central area, the strengthening structure characterized by:

a continuous frame member encircling a major expanse of the spring structure central area, including a first traverse frame segment extending along a juncture of the coil springs of a traverse row first in selected succession of such with an extra succession traverse row adjacent thereto, there being joining members closely joining together said first traverse segment and each joined pair of coil springs in said first succession traverse row and the extra succession traverse row adjacent thereto, a second traverse frame segment extending along a juncture of the coil springs of a traverse row last in the selected succession of such with an extra succession traverse row adjacent thereto, there being joining members closely joining together said second traverse segment and each joined pair of coil springs in the last traverse row and the extra succession traverse row adjacent thereto, a pair of longitudinal frame segments spaced inwardly from the spring structure side margins and extending longitudinally in between adjacent longitudinal rows of coil springs, opposite ends of the traverse frame members being connected to opposite ends of the longitudinal frame members, there being joining members, closely joining together said longitudinal frame segments and successive ones of pairs of coil springs comprised each of a coil spring in one of the adjacent longitudinal rows and a coil spring in the other of the adjacent longitudinal rows;

a strengthening pattern including a pair of elongated metal elements possessing opposing ends, located within and connected to said continuous frame member, and a plurality of metal straps with opposing ends joined to said elongated metal elements, said pattern is received against the spring structure area encircled by said continuous frame member wherein said pair of metal elements are substantially parallel to one another.

* * * * *